US011448478B2

(12) United States Patent
Wei

(10) Patent No.: US 11,448,478 B2
(45) Date of Patent: Sep. 20, 2022

(54) DRAW-STRING MECHANISM FOR CROSSBOWS

(71) Applicant: Ning Wei, Shandong (CN)

(72) Inventor: Ning Wei, Shandong (CN)

(73) Assignee: Weifang Zhaoshi Bow & Crossbow Co., Ltd., Shandong (CN)

( * ) Notice: Subject to any disclaimer, the term of this patent is extended or adjusted under 35 U.S.C. 154(b) by 0 days.

(21) Appl. No.: 17/075,670

(22) Filed: Oct. 20, 2020

(65) Prior Publication Data

US 2021/0123700 A1 Apr. 29, 2021

(30) Foreign Application Priority Data

Oct. 29, 2019 (CN) ..... 201921907957.9

(51) Int. Cl.
*F41B 5/12* (2006.01)
*F41B 5/14* (2006.01)

(52) U.S. Cl.
CPC ..... *F41B 5/12* (2013.01); *F41B 5/1469* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 7,100,590 | B2 * | 9/2006 | Chang | F41B 5/123 124/25 |
| 7,624,725 | B1 * | 12/2009 | Choma | F41B 5/1469 124/25 |
| 9,528,792 | B1 * | 12/2016 | Chang | F41B 5/1469 |
| 9,696,108 | B2 * | 7/2017 | Simonds | F41B 5/12 |
| 10,295,299 | B2 * | 5/2019 | Vergara | B66D 1/04 |
| 10,514,229 | B2 * | 12/2019 | Shaffer | F41B 5/12 |
| 10,996,018 | B1 * | 5/2021 | Kempf | F41B 5/105 |
| 2010/0170488 | A1 * | 7/2010 | Rasor | F41A 19/12 124/25 |

* cited by examiner

*Primary Examiner* — John A Ricci

(57) ABSTRACT

The invention relates to the technical field of the athletic equipment, specifically relating to a draw-string mechanism for crossbows comprising a carriage mounted inside the slideway of the crossbow limb, a hook-string board mounted on the carriage, a pull-cord device used to drive the carriage to slide back on the slideway of the crossbow limb and a reset device to draw the carriage to slide forward to its initial position; said pull-cord device includes two pull cords, a pull handle, and pull-cord pulley blocks wherein two pull cords respectively has a corresponding pull-cord pulley block and passes around the pull-cord pulley block with its end fixed inside pull handles. The invention can not only avoid hurting fingers of crossbow operators, but also generate 2-4 fold drawing force to draw string via force-increasing effect of pull-cord pulley blocks, which is very easy to operate and more labor-saving.

7 Claims, 4 Drawing Sheets

DRAW-STRING MECHANISM FOR CROSSBOWS

BACKGROUND OF THE INVENTION

1. Field of the Invention

The invention relates to the technical field of the athletic equipment, specifically relating to a draw-string mechanism for crossbows.

2. Description of the Related Art

The Crossbow, a kind of bow, is also called "cross-bow" mainly consisting of a crossbow limb, a bow, a bowstring, a crossbow mechanism and other parts. Compared with bows, the crossbow has advantages of great length, longer range, stronger power, and higher hit ratio and lower requirement on users. Shooting crossbow is a folk sport activity with a long history in minority nationality areas of China like Yunnan province, Guizhou province, Hainan province and Guangxi Zhuang Autonomous Region. In 1980s, shooting crossbow is very popular in many ethnic minorities and was listed as a competitive event in The Third National Minorities Game.

The bowstring of the traditional crossbow is drew back by operators using their hands directly, labor-consuming and apt to causing damage to fingers. Then people improved the crossbow by mounting the draw-string mechanism on the crossbow limb which can slide back and forward along its length comprising two draw-string rods respectively mounted on the left and right side with pull handles fixed at the end of draw-string rods while the front ends of two draw-string rods are respectively arranged with vertical drawl-string hooks. When operating, one hand grips the handle of the crossbow and the other hand draws back the pull handle with the drawl-string hook hooks up the bow-string to draw back to the crossbow mechanism. Such draw string device avoids hurting fingers, but it didn't solve the problem of labor-consuming in drawing string.

SUMMARY OF THE INVENTION

The purpose of the invention is to provide a draw-string mechanism for crossbows to solve above technical problems.

To solve above problems, the invention adopts following technical plan:

a draw-string mechanism for crossbows comprising a carriage mounted inside the slideway of the crossbow limb, a hook-string board mounted on the carriage, a pull-cord device used to drive the carriage to slide back on the slideway of the crossbow limb and a reset device to draw the carriage to slide forward to its initial position; said pull-cord device includes two pull cords, a pull handle, and pull-cord pulley blocks wherein two pull cords respectively has a corresponding pull-cord pulley block and passes around the pull-cord pulley block with its end fixed inside the pull handle.

Preferably, said pull-cord pulley blocks include the first pulley and the second pulley; at the end of said slideway of the crossbow limb is mounted with the first shaft at two ends thereof are fixedly mounted with two first pulleys; on said carriage is mounted with the second shaft and at two ends thereof are fixedly mounted with two second pulleys; the initiating terminal of said pull cord is equipped with a noose which is hitched to the first pulley and, after the pull cord goes forward and passes around the second pulley, it goes backward to be out of the slideway of crossbow limb with the end thereof fixed inside the pull handle.

Preferably, said pull-cord pulley blocks includes the first pulley, the second pulley and the third pulley; at the end of said slideway of said crossbow limb is mounted with the first shaft at two ends thereof are fixedly mounted with two first pulleys; on said carriage is mounted with the second shaft and the third shaft and the third shaft is at the rear side of the second shaft; two second pulleys are respectively mounted at two ends of the second shaft and two third pulleys are respectively mounted at two ends of the third shaft; the initiating terminal of said pull cord is equipped with a noose which is hitched to the third pulley and, after the pull cord goes backward and passes around the first pulley, it goes forward and passes around the second pulley, then it goes backward to be out of the slideway of crossbow limb with the end thereof fixed inside the pull handle.

Preferably, said pull-cord pulley blocks include the first pulley and the second pulley; at the end of said slideway of the crossbow limb is mounted with the first shaft at two ends thereof are fixedly mounted with two first pulleys; on said carriage is mounted with the second shaft and both of two second pulleys are equipped with two pulley grooves which are respectively and fixedly mounted at two ends of the second shaft; the initiating terminal of said pull cord is equipped with a noose which is hitched to the first pulley and, after the pull cord goes forward and passes around the outer pulley groove of the second pulley, it goes backward and passes around the first pulley, then it goes forward, passing around the inner pulley groove of the second pulley, and goes backward to be out of the slideway of crossbow limb with the end thereof fixed inside the pull handle.

Further, said reset device comprises a coilspring wheel and a coil spring mounted on the carriage via the fourth shaft wherein said coil spring is wound to the coilspring wheel and the other end is fixed to the front end of the slideway of the crossbow limb.

Further, said hook-string board is fixed at the top of the carriage and at its tail portion is symmetrically arranged with two inward-folded crossbow hooks.

Further, at both sides of the front end of said carriage is mounted with carriage wheels.

Advantageous effects: Compared with prior art, the invention can not only avoid hurting fingers of crossbow operators, but also generate 2-4 fold drawing force to draw string via force-increasing effect of pull-cord pulley blocks, which is very easy to operate and more labor-saving.

DETAILED DESCRIPTION OF THE PREFERRED EMBODIMENTS

The invention is further described in detail hereinafter with reference to the drawings.

Embodiment 1

Figure 1:
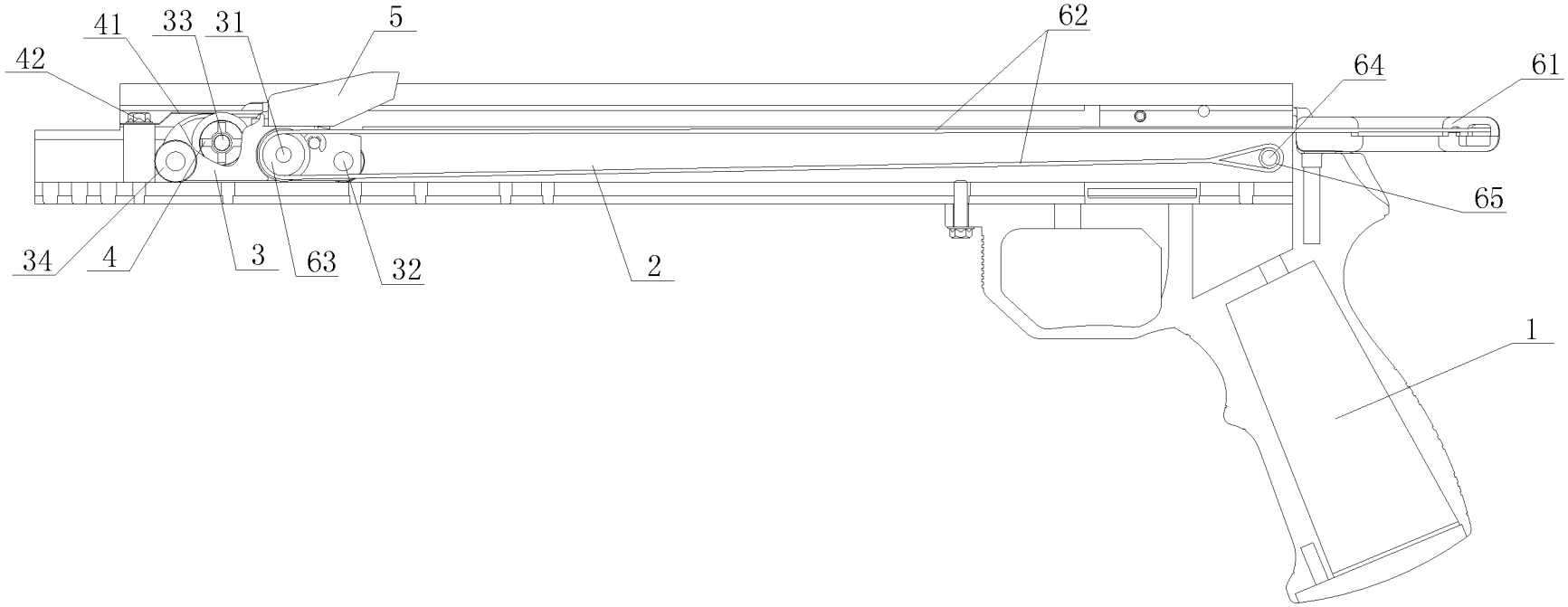
FIG. 1 is the structural diagram of embodiment 1 in the invention.
Figure 2:
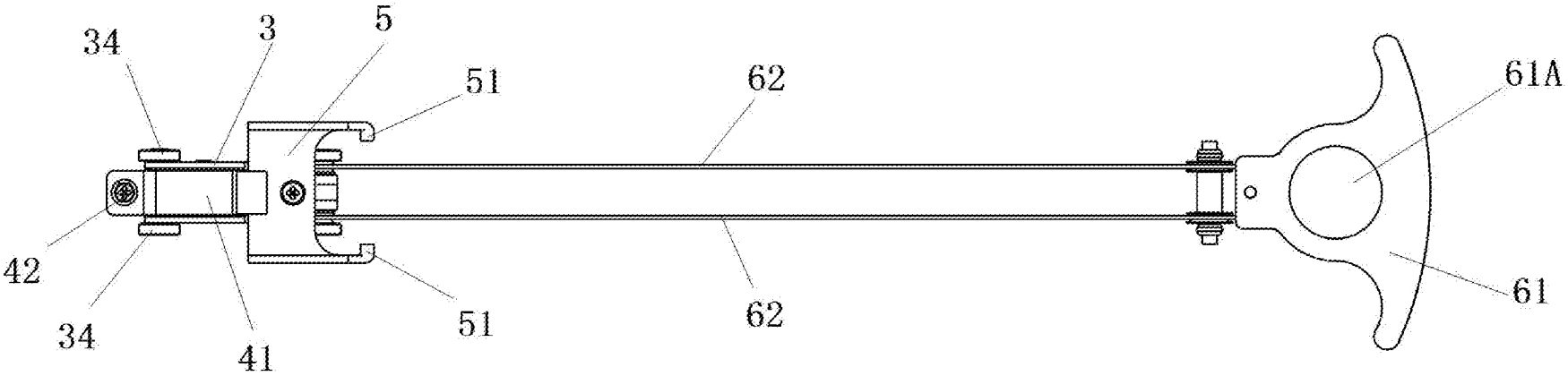
FIG. 2 is the structural diagram of the draw-string mechanism in embodiment 1.

As shown in FIG. 1 and FIG. 2, a draw-string mechanism for crossbows of the embodiment comprising a carriage 3 mounted inside the slideway 2 of the crossbow limb, a hook-string board mounted on the carriage 3, a pull-cord device used to drive the carriage 3 to slide back on the slideway 2 of the crossbow limb and a reset device to draw the carriage 3 to slide forward to its initial position; said pull-cord device includes two pull cords 62, a pull handle 61, and pull-cord pulley blocks wherein two pull cords 62 respectively has a corresponding pull-cord pulley block and passes around the pull-cord pulley block with its end fixed inside pull handles 61. Preferably, said pull handles 61 take a shape of T on the whole with a pull handle hole 61A arranged on the middle thereof.

Said pull-cord pulley blocks include the first pulley 65 and the second pulley 66; at the end of said slideway 2 of the crossbow limb is mounted with the first shaft 64 at two ends thereof are fixedly mounted with two first pulleys 65; on said carriage 3 is mounted with the second shaft 31 and at two ends thereof are fixedly mounted with two second pulleys 63; the initiating terminal of said pull cord is equipped with a noose which is hitched to the first pulley 65 and, after the pull cord goes forward and passes around the second pulley 63, it goes backward to be out of the slideway 2 of crossbow limb with the end thereof fixed inside the pull handle.

Said reset device comprises a coilspring wheel 4 and a coil spring 41 mounted on the carriage 3 via the fourth shaft 33 wherein said coil spring 41 is wound to the coilspring wheel 4 and the other end is fixed to the front end of the slideway 2 of the crossbow limb via the fixed bolt 42. Said hook-string board 5 is fixed at the top of the carriage 3 and at its tail portion is symmetrically arranged with two inward-folded crossbow hooks 51. At both sides of the front end of said carriage 3 is mounted with carriage wheels 34.

When operating, one hand of the crossbow operator grips the handle 1 of the crossbow mechanism and the other hand hooks up two ends of the pull handles 61 or the pull handle hole 61A and draws back the pull handles 61, which can generate 2 fold drawing force to draw string via force-increasing effect of pull-cord pulley blocks.

Embodiment 2

Figure 3:
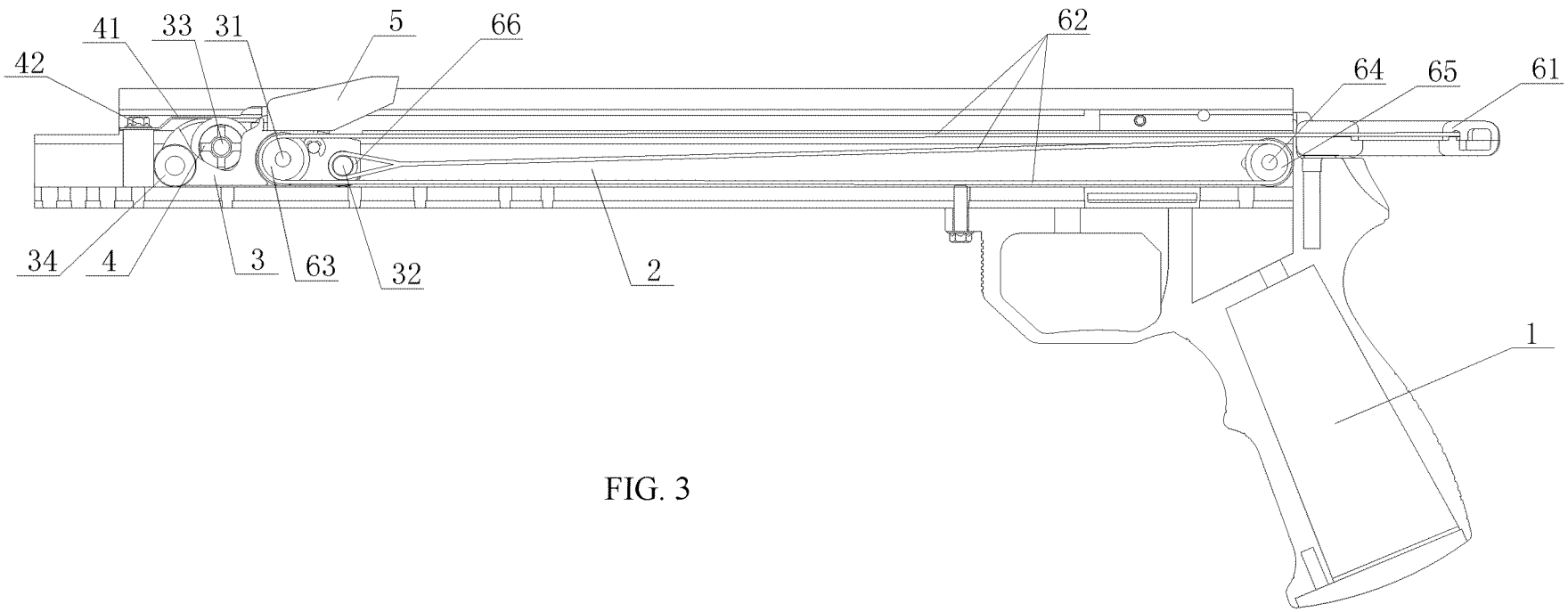
FIG. 3 is the structural diagram of embodiment 2 in the invention.
Figure 4:
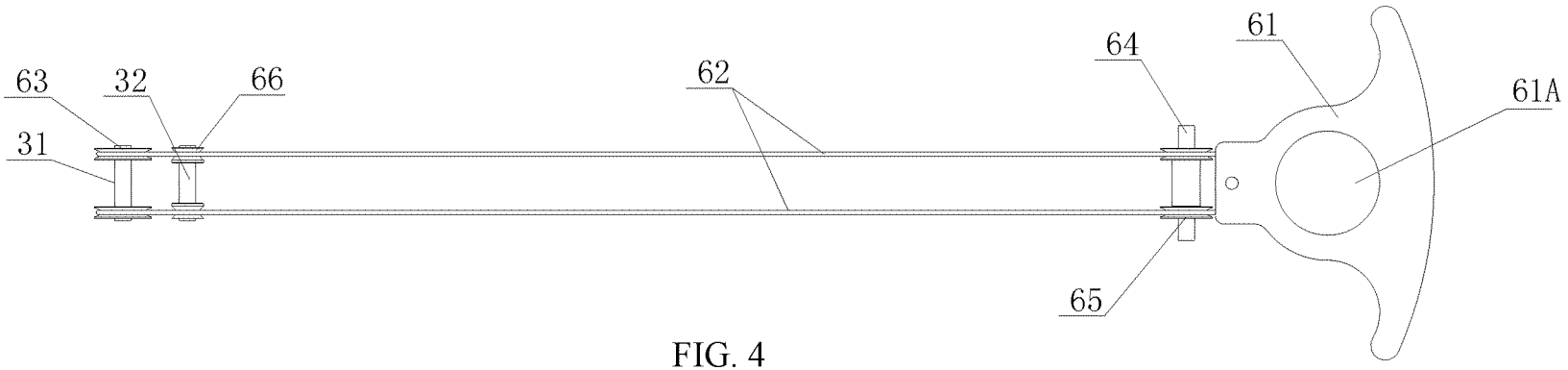
FIG. 4 is the structural diagram of the pull-cord device in embodiment 2.

As shown in FIG. 3 and FIG. 4, a draw-string mechanism for crossbows of the embodiment comprising a carriage 3 mounted inside the slideway 2 of the crossbow limb, a hook-string board mounted on the carriage 3, a pull-cord device used to drive the carriage 3 to slide back on the slideway 2 of the crossbow limb and a reset device to draw the carriage 3 to slide forward to its initial position; said pull-cord device includes two pull cords 62, a pull handle 61, and pull-cord pulley blocks wherein two pull cords 62 respectively has a corresponding pull-cord pulley block and passes around the pull-cord pulley block with its end fixed inside pull handles 61. Preferably, said pull handles 61 take a shape of T on the whole with a pull handle hole 61A arranged on the middle thereof.

Said pull-cord pulley blocks includes the first pulley 65, the second pulley 63 and the third pulley 66; at the end of said slideway 2 of said crossbow limb is mounted with the first shaft 64 at two ends thereof are fixedly mounted with two first pulleys 65; on said carriage 3 is mounted with the second shaft 31 and the third shaft 32 and the third shaft 32 is at the rear side of the second shaft 31; two second pulleys 63 are respectively mounted at two ends of the second shaft 31 and two third pulleys 66 are respectively mounted at two ends of the third shaft 32; the initiating terminal of said pull cord 62 is equipped with a noose which is hitched to the third pulley 66 and, after the pull cord 62 goes backward and passes around the first pulley 65, it goes forward and passes around the second pulley 63, then it goes backward to be out of the slideway 2 of crossbow limb with the end thereof fixed inside the pull handle 61.

Said reset device comprises a coilspring wheel 4 and a coil spring 41 mounted on the carriage 3 via the fourth shaft 33 wherein said coil spring 41 is wound to the coilspring wheel 4 and the other end is fixed to the front end of the slideway 2 of the crossbow limb via the fixed bolt 42. Said hook-string board 5 is fixed at the top of the carriage 3 and at its tail portion is symmetrically arranged with two inward-folded crossbow hooks 51 (As seen in FIG. 2). At both sides of the front end of said carriage 3 is mounted with carriage wheels 34.

When operating, one hand of the crossbow operator grips the handle 1 of the crossbow mechanism and the other hand hooks up two ends of the pull handles 61 or the pull handle hole 61A and draws back the pull handles 61, which can generate 3 fold drawing force to draw string via force-increasing effect of pull-cord pulley blocks.

Embodiment 3

Figure 5:
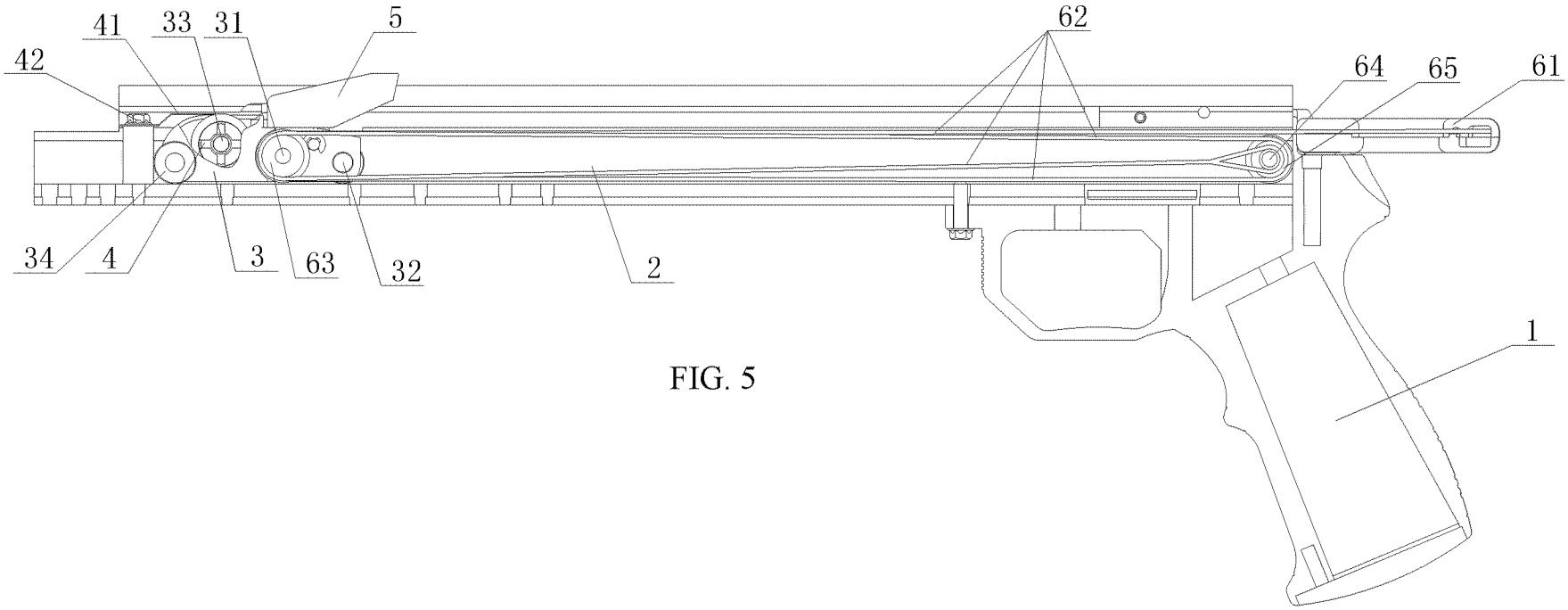
FIG. 5 is the structural diagram of embodiment 3 in the invention.
Figure 6:
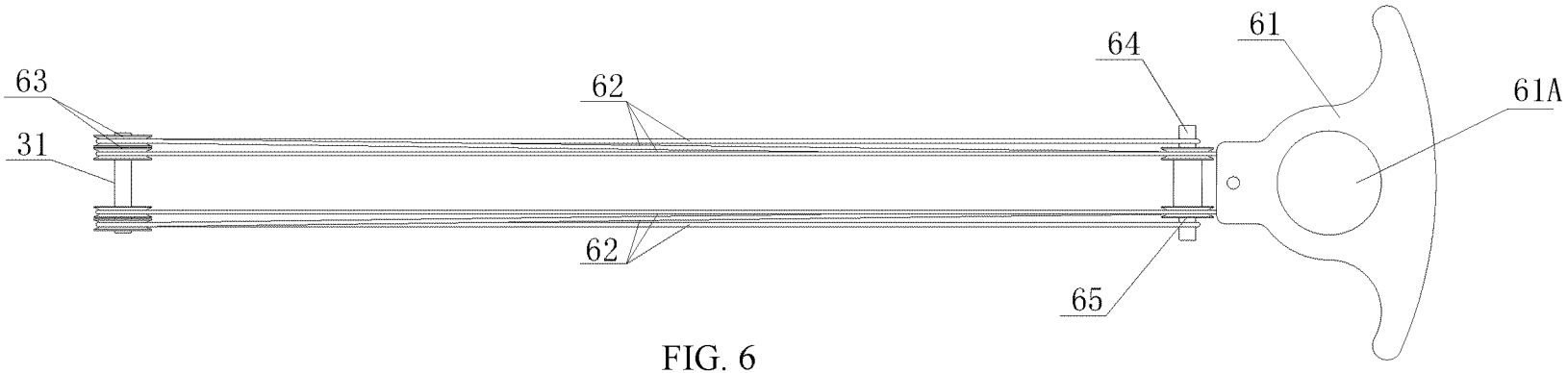
FIG. 6 is the structural diagram of the pull-cord device in embodiment 3.

As shown in FIG. 5 and FIG. 6, a draw-string mechanism for crossbows of the embodiment comprising a carriage 3 mounted inside the slideway 2 of the crossbow limb, a hook-string board mounted on the carriage 3, a pull-cord device used to drive the carriage 3 to slide back on the slideway 2 of the crossbow limb and a reset device to draw the carriage 3 to slide forward to its initial position; said pull-cord device includes two pull cords 62, a pull handle 61, and pull-cord pulley blocks wherein two pull cords 62 respectively has a corresponding pull-cord pulley block and passes around the pull-cord pulley block with its end fixed inside pull handles 61. Preferably, said pull handles 61 take a shape of T on the whole with a pull handle hole 61A arranged on the middle thereof.

Said pull-cord pulley blocks include the first pulley 65 and the second pulley 63; at the end of said slideway 2 of the crossbow limb is mounted with the first shaft 64 at two ends thereof are fixedly mounted with two first pulleys 65; on said carriage 3 is mounted with the second shaft 31 and both of two second pulleys 63 are equipped with two pulley grooves which are respectively and fixedly mounted at two ends of the second shaft 31; the initiating terminal of said pull cord 2 is equipped with a noose which is hitched to the first pulley 64 and, after the pull cord 2 goes forward and passes around the outer pulley groove of the second pulley 63, it goes backward and passes around the first pulley 65, then it goes forward, passing around the inner pulley groove of the second pulley 63, and goes backward to be out of the slideway 2 of crossbow limb with the end thereof fixed inside the pull handle 61.

Said reset device comprises a coilspring wheel 4 and a coil spring 41 mounted on the carriage 3 via the fourth shaft 33 wherein said coil spring 41 is wound to the coilspring wheel 4 and the other end is fixed to the front end of the slideway 2 of the crossbow limb via the fixed bolt 42. Said hook-string board 5 is fixed at the top of the carriage 3 and at its tail portion is symmetrically arranged with two inward-folded crossbow hooks 51 (As shown in FIG. 2). At both sides of the front end of said carriage 3 is mounted with carriage wheels 34.

When operating, one hand of the crossbow operator grips the handle 1 of the crossbow mechanism and the other hand hooks up two ends of the pull handles 61 or the pull handle hole 61A and draws back the pull handles 61, which can generate 4 fold drawing force to draw string via force-increasing effect of pull-cord pulley blocks.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

The invention claimed is:

1. A draw-string mechanism for crossbows comprising a carriage mounted inside a slideway of a crossbow limb, a hook-string board mounted on the carriage, a pull-cord device used to drive the carriage to slide back on the slideway of the crossbow limb and a reset device to draw the carriage to slide forward to its initial position; said pull-cord device includes two pull cords, a pull handle, and pull-cord pulley blocks, wherein two pull cords respectively has a corresponding pull-cord pulley block and passes around the pull-cord pulley block, and ends of the pull cords are fixed inside the pull handle.

2. The draw-string mechanism for crossbows of claim 1 wherein said pull-cord pulley blocks include a first pulley and a second pulley; at the end of said slideway of the crossbow limb is mounted with a first shaft at two ends thereof are fixedly mounted with two first pulleys; on said carriage is mounted with a second shaft and at two ends thereof are fixedly mounted with two second pulleys; an initiating terminal of said pull cord is equipped with a noose which is hitched to the first pulley and, after the pull cord goes forward and passes around the second pulley, it goes backward to be out of the slideway of crossbow limb with the end thereof fixed inside the pull handle.

3. The draw-string mechanism for crossbows of claim 2 wherein said reset device comprises a coilspring wheel and a coil spring mounted on the carriage via a fourth shaft, wherein said coil spring is wound to the coilspring wheel and the other end is fixed to the front end of the slideway of the crossbow limb; said hook-string board is fixed at the top of the carriage and at its tail portion is symmetrically arranged with two inward-folded crossbow hooks; at both sides of the front end of said carriage is mounted with carriage wheels.

4. The draw-string mechanism for crossbows of claim 1 wherein said pull-cord pulley blocks include a first pulley, a second pulley and a third pulley; at the end of said slideway of said crossbow limb is mounted with a first shaft at two ends thereof are fixedly mounted with two first pulleys; on said carriage is mounted with a second shaft and a third shaft, and the third shaft is at the rear side of the second shaft; two second pulleys are respectively mounted at two ends of the second shaft, and two third pulleys are respectively mounted at two ends of the third shaft; an initiating terminal of said pull cord is equipped with a noose which is hitched to the third pulley and, after the pull cord goes backward and passes around the first pulley, it goes forward and passes around the second pulley, then it goes backward to be out of the slideway of crossbow limb with the end thereof fixed inside the pull handle.

5. The draw-string mechanism for crossbows of claim 4 wherein said reset device comprises a coilspring wheel and a coil spring mounted on the carriage via a fourth shaft, wherein said coil spring is wound to the coilspring wheel and the other end is fixed to the front end of the slideway of the crossbow limb; said hook-string board is fixed at the top of the carriage and at its tail portion is symmetrically arranged with two inward-folded crossbow hooks; at both sides of the front end of said carriage is mounted with carriage wheels.

6. The draw-string mechanism for crossbows of claim 1 wherein said pull-cord pulley blocks include a first pulley and a second pulley; at the end of said slideway of the crossbow limb is mounted with a first shaft at two ends thereof are fixedly mounted with two first pulleys; on said carriage is mounted with a second shaft and both of two second pulleys are equipped with two pulley grooves which are respectively and fixedly mounted at two ends of the second shaft; an initiating terminal of said pull cord is equipped with a noose which is hitched to the first pulley and, after the pull cord goes forward and passes around an outer pulley groove of the second pulley, it goes backward and passes around the first pulley, then it goes forward, passing around an inner pulley groove of the second pulley, and goes backward to be out of the slideway of crossbow limb with the end thereof fixed inside the pull handle.

7. The draw-string mechanism for crossbows of claim 6 wherein said reset device comprises a coilspring wheel and a coil spring mounted on the carriage via a fourth shaft, wherein said coil spring is wound to the coilspring wheel and the other end is fixed to the front end of the slideway of the crossbow limb; said hook-string board is fixed at the top of the carriage and at its tail portion is symmetrically arranged with two inward-folded crossbow hooks; at both sides of the front end of said carriage is mounted with carriage wheels.

* * * * *